United States Patent [19]

Katz

[11] 4,423,829

[45] Jan. 3, 1984

[54] APPARATUS FOR CONTAINING AND DISPENSING FLUIDS UNDER PRESSURE AND METHOD OF MANUFACTURING SAME

[75] Inventor: Hyman Katz, Montreal, Canada

[73] Assignee: Container Industries Inc., Londonderry, N.H.

[21] Appl. No.: 182,115

[22] Filed: Aug. 28, 1980

[51] Int. Cl.[3] ..... B65D 37/00

[52] U.S. Cl. ..... 222/95; 222/105; 222/212; 222/215; 222/386.5; 493/213; 493/217; 53/469

[58] Field of Search ..... 222/94–95, 222/105, 131, 183, 212, 214, 215, 386.5, 387, 336, 1; 239/323, 327–328; 493/217, 213, 215; 53/140, 403, 412, 449, 469, 470

[56] References Cited

U.S. PATENT DOCUMENTS

| | | | |
|---|---|---|---|
| 2,804,995 | 9/1957 | Fee . | |
| 2,816,690 | 12/1957 | Lari . | |
| 2,966,282 | 12/1960 | Geisler . | |
| 3,083,871 | 4/1963 | Jepson . | |
| 3,087,655 | 4/1963 | Scholle . | |
| 3,199,742 | 8/1965 | Hill . | |
| 3,323,206 | 6/1967 | Clark . | |
| 3,552,604 | 1/1971 | Gordon . | |
| 3,580,427 | 5/1971 | Clarke . | |
| 3,672,543 | 6/1972 | Roper et al. . | |
| 3,733,309 | 5/1973 | Wyeth et al. . | |
| 3,738,538 | 6/1973 | Roper et al. . | |
| 3,745,149 | 7/1973 | Serafini et al. . | |
| 3,745,150 | 7/1973 | Corsover . | |
| 3,767,078 | 10/1973 | Gortz et al. . | |
| 3,791,098 | 2/1974 | Webster . | |
| 3,791,557 | 2/1974 | Venus, Jr. | 222/214 X |
| 3,796,356 | 3/1974 | Venus . | |
| 3,803,275 | 4/1974 | Corsover . | |
| 3,876,115 | 4/1975 | Venus, Jr. et al. . | |
| 3,907,169 | 9/1975 | Gortz et al. | 222/95 |
| 3,940,026 | 2/1976 | Kain . | |
| 3,946,905 | 3/1976 | Cogliano | 222/107 |
| 3,961,725 | 6/1976 | Clark . | |
| 3,981,415 | 9/1976 | Fowler et al. | 222/215 X |
| 4,052,866 | 10/1977 | Saunders . | |
| 4,067,499 | 1/1978 | Cohen . | |
| 4,077,543 | 3/1978 | Kulikowski et al. . | |
| 4,095,724 | 6/1978 | Perusco . | |
| 4,098,434 | 7/1978 | Uhlig . | |
| 4,121,737 | 10/1978 | Kain | 222/212 X |
| 4,203,440 | 5/1980 | Theeuwes . | |
| 4,222,499 | 9/1980 | Lee et al. | 222/215 X |
| 4,251,032 | 2/1981 | Werding | 222/386.5 X |

FOREIGN PATENT DOCUMENTS

| | | |
|---|---|---|
| 78371 | 8/1976 | Australia . |
| 2304538 | 8/1974 | Fed. Rep. of Germany . |
| 2442328 | 3/1975 | Fed. Rep. of Germany . |
| 2704013 | 8/1978 | Fed. Rep. of Germany . |

OTHER PUBLICATIONS

G. S. Kirshenbaum and J. M. Rhodes, "Thermoplastic Polyester: PET, Reprinted from 1979–1980 Modern Plastics Encyclopedia by McGraw-Hill, Inc., Copyright 1979, (two pp.).

American Hoechst Corp., "Hoechst (Registered Trademark) Thermoplastic PET Resin (Preliminary Technical Bulletin)".

Prof. R. B. Seymour, "The Narrowing Field of Plastics for Blow Molded Beverage Containers," *Plastics Design & Processing*, pp. 61–65, Jun. 1977.

D. D. Ray, C. B. Schriver and R. J. Gartland, "Here's Why Polyethylene Terephthalate Is the Major Competitor for Beverage Container Applications (Part 2–PET Processing Methods)," *Plastics Design & Processing*, pp. 47–50, Sep. 1977.

R. B. Fredrickson and R. O. Braselton, "Stretch–Blow Molding for Packaging Versatility," *Plastics Design & Processing*, pp. 22–26, Nov. 1979.

C. Schriver, "How to Reheat Blow Mold PET Soft--Drink Bottles," *Plastics Technology*, pp. 91–93, Oct. 1977.

*Primary Examiner*—Charles A. Marmor

*Attorney, Agent, or Firm*—Pennie & Edmonds

[57] ABSTRACT

An apparatus for containing and dispensing a liquid under pressure includes a flexible container, preferably blow molded of a plastic composition, defining an inner region for containing the fluid under pressure. The container is inert with respect to the liquid contained therein and has a plurality of longitudinally extending creases to allow folding of the flexible container inwardly along the creases. The flexible container is capable of being folded along the creases in its empty condition radially and expanded when filled with the fluid under pressure. A tubular fabric sleeve open at both ends which is elastic in radial directions surrounds the flexible container in its folded condition. A tubular resilient member also open at both ends is positioned about the fabric sleeve when the flexible container is in its folded condition. The resilient member is controlled by frictional interaction with the fabric sleeve so as to be capable of expanding in substantially radial directions when the flexible container is filled with the fluid under pressure. A method of producing the inventive apparatus is also disclosed.

50 Claims, 11 Drawing Figures

APPARATUS FOR CONTAINING AND DISPENSING FLUIDS UNDER PRESSURE AND METHOD OF MANUFACTURING SAME

TECHNICAL FIELD

This invention relates to an apparatus for containing and dispensing fluids under pressure, and in particular to a non-aerosol container assembly for dispensing fluids or the like therefrom, and method of manufacturing same.

BACKGROUND ART

It is well known to employ fluorocarbons as propellants in dispensing fluids under pressure in container-like structures. However, recent environmental concern regarding the use of fluorocarbons and their potentially harmful effects on the ozone layers of the upper atomosphere has prompted a search for a replacement of such fluorocarbons. One such replacement includes the use of hydrocarbons which, however, have undesirable after effects and inherent dangers as well. In particular, hydrocarbons provide a flammable medium which in itself presents the danger of explosion and/or fire. Moreover, the use of propellants requires that the containers be constructed of sufficient strength so as to preserve and maintain the pressures generated within such containers. As a result, the use of such propellants provides an ever-present inherently dangerous situation in that rough handling or puncturing of the outer containers at any time can cause explosions.

Accordingly, attempts to avoid the use of propellants such as fluorocarbons or hydrocarbons have included resorting to the use of mechanical pump systems. Such pump devices disadvantageously require constant manual manipulations or pumping simply to provide release and dispersal of the fluid from the container as is typically obtained by propellant devices as noted above.

In view of the above-noted deficiencies of prior art systems, devices have been developed which incorporate an elastomeric member as described and illustrated in U.S. Pat. Nos. 3,672,543 and 3,738,538 to Roper et al.; 3,791,557 and 3,796,356 to Venus, Jr.; 3,876,115 to Venus, Jr. et al. and 3,961,725 to Clark. In the above-noted patents an elastomeric container serves to contain a fluid and is positioned within a housing whose shape the elastomeric container is intended to assume upon expansion. A valve structure positioned atop the housing communicates with the fluid within the elastomeric container. Upon activation of the valve structure, the fluid is expelled by means of the force exerted by the contraction of the elastomeric container to an unexpanded state. Furthermore, each of the patents noted above incorporates a mandrel which is positioned centrally of the elastomeric container and provides for prestressing of the container and/or evacuation of the fluid along channels or grooves along the length of the mandrel.

Such prior art devices, however, inherently suffer from the problem of odor contamination of the fluid by the rubber composition of the container. Moreover, in these devices filling the container often results in unregulated expansion. For this reason, the container can expand into various shapes and in certain instances the container expands into contact with the inner surface of the housing prior to achieving full expansion within the housing. As a result, portions of the container are subjected to frictional forces during expansion. This in turn produces wear and tear in the container structure which may thereafter operate erratically, i.e., not produce constant expression of fluid throughout the range of evacuation of the container upon activation of the valve structure. In some instances, the container may become damaged and even rendered inoperative.

In an attempt to overcome the first of the abovementioned deficiencies, U.S. Pat. No. 4,121,737 to Kain discloses an apparatus having a pressure container of suitable elastomeric material such as rubber which envelops a flexible fluid-tight bag or liner. Such liner is provided in order to prevent the fluid from contacting the elastomeric material of the pressure unit and thus to avoid acquiring undesirable odors or flavors. However, as is the case with the other patents noted above, the device of the Kain patent does not provide control or regulation for the expansion of the pressure container. Accordingly, the container expands within the housing in an uncontrolled fashion and often contacts the inner walls of the housing during its expansion. Thus, the device of the Kain patent does not avoid the distortion disadvantages and operational limitations resulting therefrom as noted above.

In addition, in known devices which employ a liner within an elastomeric container, the liner is generally of a uniform construction which does not permit easy folding about a given axis. Rather, as is the case with the device of the Kain patent, the liner is crumpled within the elastomeric container prior to being filled with a fluid. Moreover, the known liners constructed of a material of uniform thickness throughout have been known to undergo blowouts during the filling process during which greater pressures are exerted against certain portions of the liner. Blowouts have also been known to occur in liners constructed as enclosed containers and sealed in position within an outer housing. In such instances the seals themselves may weaken and rupture during filling or use. I have invented an apparatus and a method of manufacturing an apparatus for containing and dispensing fluids under pressure which overcomes the above-noted limitations of the prior art.

DISCLOSURE OF THE INVENTION

The present invention relates to an apparatus for containing and dispensing a fluid medium under pressure comprising substantially inert flexible means defining an inner region for containing the fluid medium under pressure and capable of being folded about one axis in its empty condition and expanded at least in directions substantially transverse to the axis when filled with the fluid medium under pressure. A sleeve is disposed outwardly of, and surrounding the flexible container means. The sleeve is generally resilient at least in directions substantially transverse to the axis. A resilient tubular member is positioned outwardly of the sleeve and extends at least over the length of the sleeve and is resiliently expandable in directions substantially transverse to the axis when the flexible container means is filled with the fluid medium under pressure. Valve means is connected to the flexible container means and adapted to substantially prevent evacuation of the flexible container means under normal conditions and capable of selectively providing communication between the inner region of the flexible container means and the outside atmosphere thereby to permit selective amounts of the pressurized fluid medium to exit the flexible container due to the generally radially inward forces provided by the resilient member in its generally expanded condition.

In a preferred embodiment, the present invention relates to an apparatus for containing and dispensing a fluid under pressure comprising preferably a synthetic polymeric, substantially non-elastomeric flexible container defining an inner region for containing the fluid under pressure and capable of being folded in its empty condition and expanded at least in substantially radial outward directions when filled with the fluid under pressure. The container is constructed of a material which is substantially inert with respect to the fluid to be contained therein. By "substantially inert" is meant that the material resists significant chemical or physical action by the fluid, thus avoiding leaching of undesirable amounts of the container material or its chemical components into the fluid.

A sleeve disposed radially outwardly of and surrounding the flexible container is generally resilient at least in radial directions and capable of being expanded at least in generally radial directions when the flexible container is filled with the fluid under pressure. A resilient tubular member positioned radially outwardly of the sleeve extends at least over the length of the sleeve and is resiliently expandable in radial directions when the flexible container is filled with the fluid under pressure. Valve means connected to the flexible container and adapted to substantially prevent evacuation of the flexible container under normal conditions is capable of selectively providing communication between the inner region of the flexible container and the outside atmosphere thereby to permit selective amounts of the pressurized fluid to exit the flexible container due to the generally radially inward forces provided by the resilient member in its generally expanded condition.

The flexible container is preferably constructed of a material which is substantially inert with respect to the liquid to be contained in the inner region and the tubular sleeve is constructed predominantly of knitted nylon yarns with resilient yarns positioned generally circumferentially therein at spaced locations along the length of the sleeve. The resilient tubular member is constructed of a suitable resilient material and extends over at least the length of the predominantly textile sleeve. The combination of the predominantly textile sleeve interfacing with the resilient tubular member—or energy tube—provides frictional interaction therebetween at least along longitudinal directions such that filling the flexible container with a liquid under pressure results in controlled—or programmed—uniform expansion of the resilient tubular member in radial directions along its length with extremely minor, or negligible variations. Thus, it will be seen that such uniform pressurized filling of the flexible container also provides systematic and uniform selective expulsion of the liquid as may be desired.

Preferably, the flexible container is formed of a plastic material integrally blow molded into the desired shape. The blow molded container has a plurality of longitudinally extending creases so as to permit inward folding along the creases. Preferably the blow molded container is generally cylindrical and has an aperture at one end thereof. The aperture permits connecting the blow molded container with the valve means and communication of the inner region with the outside atmosphere. Also, the blow molded container has an outwardly extending integral flange adjacent the one end so as to facilitate its connection to the valve means. The blow molded container wall has a thicker cross-sectional construction at both ends so as to render it capable of withstanding the pressure caused by the liquid under pressure.

Alternatively, the flexible container can be integrally blow molded as a co-extruded double wall construction. The double wall construction is composed of at least two layers, an inner and an outer layer. The inner layer is contiguous to the inner region within the flexible container. Although other suitable passive materials of sufficient strength are contemplated, preferably, the inner layer is polypropylene while the outer layer may be one of polyester and polyamide, such as nylon.

The predominantly textile sleeve is preferably composed of warp-knitted textile fiber yarns at least in the longitudinal direction of the flexible container. As noted above, the textile fiber yarns are preferably constructed of nylon so as to provide the proper frictional interaction between the textile sleeve and the resilient tubular member such that expansion of the resilient tubular member is regulated to have substantially negligible variation along the longitudinal direction when the flexible container is filled with the liquid under pressure. The resilient yarn-like members are composed of a suitable elastic material such as synthetic or natural rubber or the like such that expansion of the resilient tubular member is regulated in substantially radial directions along its length when the flexible container is filled with the liquid under pressure. The predominantly textile sleeve has a length approximately equal to the length of the flexible container and is open at both ends.

The resilient tubular member preferably is constructed of rubber and also has a length approximately equal to the length of the flexible container. In addition, the resilient tubular member is open at both ends and has an inner diameter less than the outer diameter of the predominantly textile sleeve so as to provide a tight fitting assembly for the predominantly textile sleeve together with the flexible container when it is positioned thereabout.

The present invention also relates to a method for manufacturing an apparatus for containing and dispensing a liquid under pressure comprising molding a moldable material into an elongated flexible container defining a inner region for containing the liquid and having at least one aperture, creating a plurality of creases extending along the longitudinal axis of the flexible container so as to permit the molded container to be folded inwardly along the creases, positioning valve means within the aperture and attaching the flexible container to the valve means so as to form a substantially sealed molded container defining an inner region for containing liquid, folding the flexible container inwardly along the creases along a longitudinal axis extending through said valve means, positioning an elongated tubular sleeve radially outwardly of, and surrounding the folded flexible container, the sleeve having generally resilient properties at least in radial directions, and positioning a resilient tubular member outwardly of and surrounding the sleeve, the resilient member extending at least over the length of the sleeve and capable of being expanded at least in radial directions as the flexible container means is filled with the liquid medium under pressure so as to provide sufficient potential energy within the resilient member such that selectively actuating the valve means provides communication between the inner region of the flexible container and the outside atmosphere while the expanded resilient tubular member causes expulsion of the liquid from the inner region of the flexible container through the valve means to the outside atmosphere.

Preferably the inner container is formed from a blow-molding process. Also, it should be noted that the method of the invention may be practiced without the step of positioning an elongated tubular sleeve radially outwardly of, and surrounding the folded flexible container, thus eliminating the elongated tubular sleeve.

According to a preferred method, the major portion of the flexible container has a generally cylindrical appearance, with a star-like cross-section when in its folded condition. The container also has a neck portion at one upper end and a closed lower end portion. The apparatus for containing and dispensing a liquid under pressure can be positioned, if desired, into an outer rigid or semi-rigid container housing.

The method of the invention also comprises pumping liquid under pressure into the flexible container through the valve means so as to cause generally radial expansion of at least the flexible container and the resilient tubular member at least sufficient to provide a predetermined liquid quantity and pressure within the inner region of the flexible container.

BRIEF DESCRIPTION OF THE DRAWINGS

The present invention is described in detail below herein with reference to the drawings in which.

BEST MODE FOR CARRYING OUT THE INVENTION

In the description which follows, any reference to either orientation or direction is intended primarily for the purpose of illustration and is not intended in any way as a limitation of the scope of the present invention.

Referring to the FIGS., an apparatus 10 is illustrated and includes a container assembly 12 constructed according to the invention and positioned within outer container housing 14. Outer container housing 14 may be suitably bottle-shaped as shown, and may be constructed of any suitable rigid or semi-rigid material, such as plastic, metal, glass, paper, etc.

Figure 1:
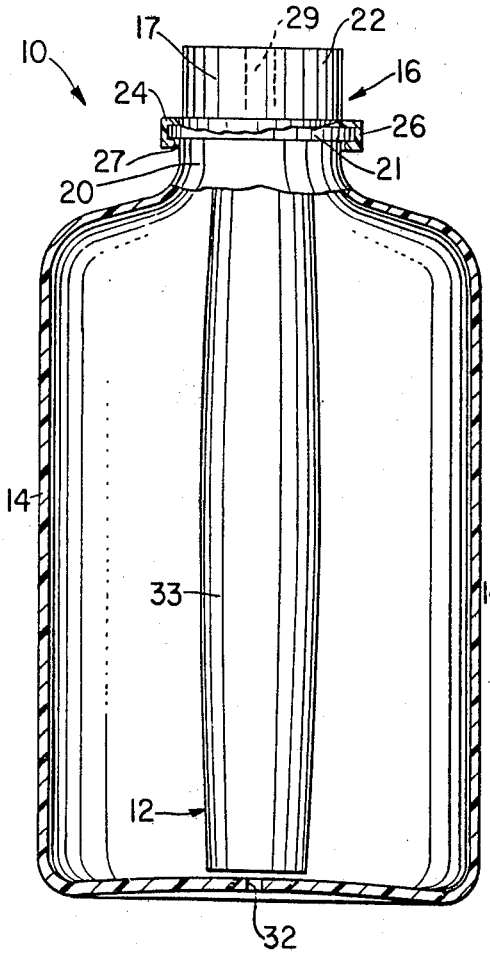
FIG. 1 is a side view, partially in cross section, of the apparatus according to the present invention illustrated in position in a container housing and showing the container assembly in an empty condition.
Figure 2:
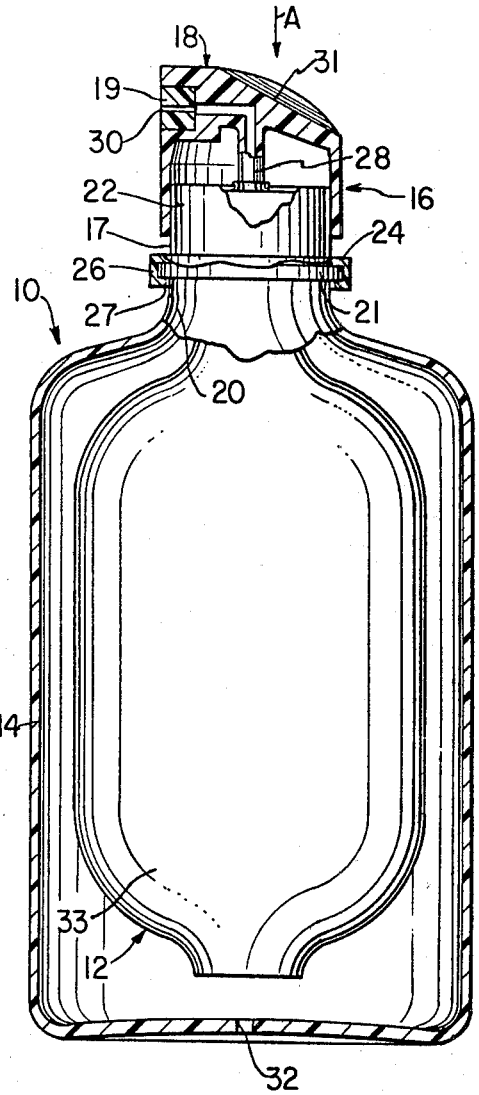
FIG. 2 is a side elevational view, partially in cross-section, of the apparatus of FIG. 1 illustrating the container assembly filled with a liquid medium under pressure.

The apparatus 10 also includes valve assembly 16 as shown in FIGS. 1 and 2. In particular, valve assembly 16 includes a retainer ring 17 as shown in FIG. 1 which permits securing the valve assembly 16 to the container housing 14. The valve assembly 16 as shown in FIG. 2 further includes an actuator cap 18 which includes additional liquid dispersal and dispensing structure 19. In particular, the additional valve structure 19 is properly of the type which provides first for a mechanical breakup of a liquid followed by a dispersal of the liquid upon discharge from the valve assembly 16. Other suitable valve devices may be utilized. Fluid, preferably a liquid, to be dispensed from the apparatus 10, is retained in the container assembly 12. The housing 14 at its upper end has a neck 20 which has a smaller diameter than the major portion of the housing 14. The neck 20 terminates in an annular flange 21 which borders an opening suitably sized to permit passage of the container assembly 12 into the housing 14.

The valve assembly 16 is secured to one end of the container assembly 12 which will be described in greater detail below. The retainer ring 17 which at its lower end has an outwardly extending flange 24, includes an upper portion 22 which is configured to be snap fitted over the flange 21 of the container housing 14. The flange 24 has a downwardly extending wall 26 which has a plurality of spaced apart inwardly directed lips 27 extending inwardly about its lower periphery. As shown in FIG. 1, the lips 27 engage the undersurface of flange 21 so as to securely fasten the valve assembly 16 to the container housing 14 to secure the container assembly 12 within the housing 14.

The retainer ring 17 of the valve assembly 16, as shown in FIG. 2, is adapted for mating with the actuator cap 18 having a stem 28 positioned for selective insertion into an aperature 29 centrally positioned in the upper portion 22. As indicated above, the actuator cap 18 provides for a mechanical breakup of the fluid followed by a dispersal of the liquid upon discharge from the valve assembly 16. In use, the actuator cap is depressed in the direction of arrow "A" as shown in FIG. 2, which in turn provides for the dispensing of liquid within the container assembly 12 through the valve assembly 16, and final dispersal from the actuator cap through a suitable opening 30 in communication with aperture 29 to provide a fine liquid mist of spray, as may be desired. The actuator cap 18 has a recessed portion 31 to accomodate a finger of a human hand. The forward wall of the actuator cap 18 containing opening 30 is transverse to the opening 30 to more easily permit directing the liquid dispersed from the apparatus 10.

The apparatus 10 is shown in FIG. 1 in its final assembly prior to filling the container assembly 12 with a liquid to be dispensed. Upon such filling, which is accomplished by conventional means providing for an automatic operation, the container assembly 12 expands within the housing 14 as illustrated in FIG. 2. To aid in the filling operation of the container assembly 12, one or more small holes 32 may be provided preferably in the bottom of housing 14 to permit bleed air to escape. The air can also escape at the upper end from between the wall 26 and flange 21 since the lips 27 are not continuous about the lower circumference of wall 26, but rather are spaced apart as noted above.

Figure 4:
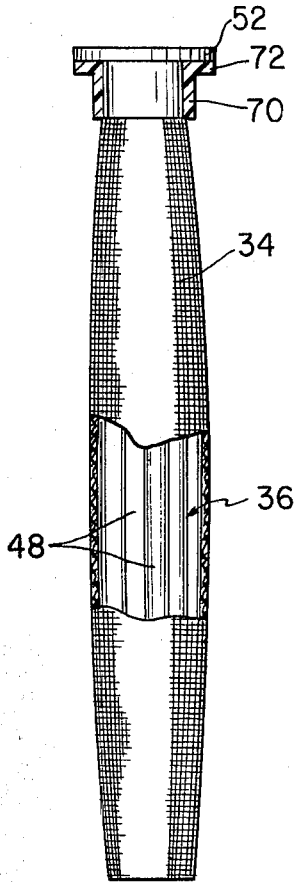
FIG. 4 is a side elevational view, partially cut away, of a blow molded flexible inner container in a folded condition and surrounded by the fabric sleeve of FIG. 3.
Figure 3:
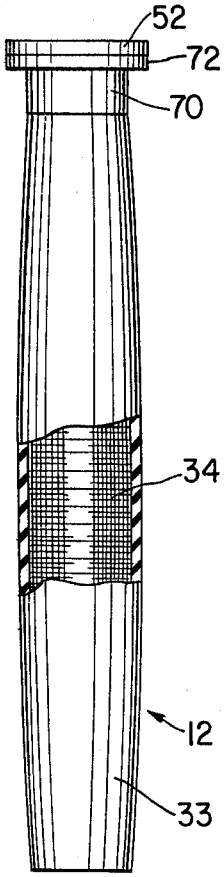
FIG. 3 is a side elevational view, partially cut away, of a container assembly illustrating a resilient energy sleeve in position about a fabric sleeve.

Referring to FIGS. 3 and 4, the container assembly 12 is shown in detail as including an energy tube 33 which envelopes a fabric sleeve 34. The fabric sleeve 34 itself envelopes a flexible container or barrier pack 36. The purpose and function of the individual components of the container assembly 12 will now be described in detail below. The valve assembly 16 is shown in particular in FIGS. 3 and 4 as including a valve structure 53 which is adapted to be enclosed within retainer ring 17 as shown in FIGS. 1 and 2.

Figure 5:
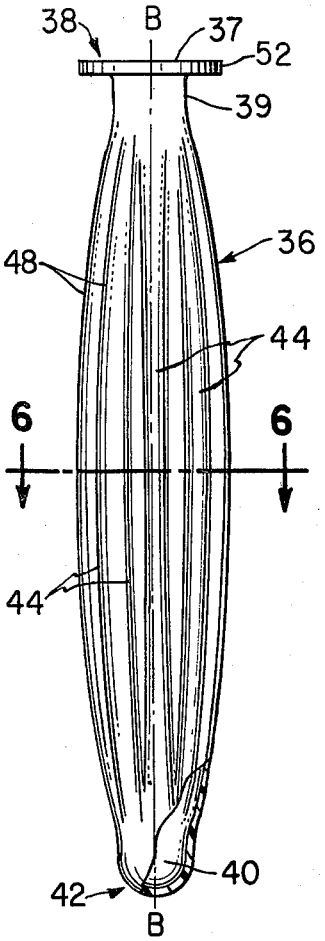
FIG. 5 is a side elevational view, partially in cross-section, illustrating the blow molded flexible inner container of FIG. 4.
Figure 6:
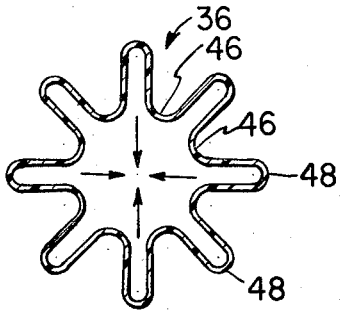
FIG. 6 is a cross-sectional view taken along the lines 6—6 of FIG. 5.
Figure 7:
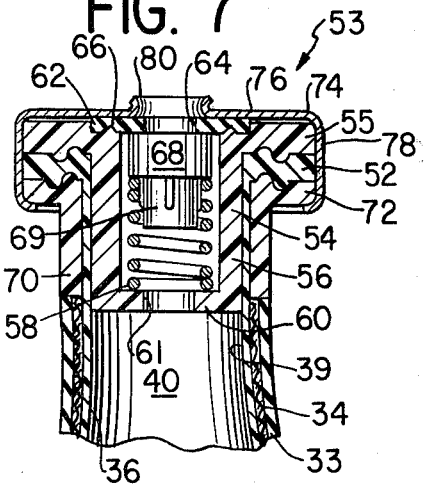
FIG. 7 is an enlarged cross-sectional view of the valve assembly of FIG. 1 connected to the container assembly of FIG. 3.

The structural features of the container assembly 12 will now be described with respect to the method of the present invention. Referring now to FIGS. 5–7, the flexible container or barrier pack 36 is constructed by integrally blow molding a plastic material by conventional methods known to those skilled in the art into the configuration as shown in FIG. 5. Preferably the plastic material is non-elastomeric and is of a homogeneous composition which may be either of a single plastic or a homongeneous mixture of a plurality of plastics or other suitable material. An aperture 37 is provided at the top end 38 so as to permit communication with the inner region 40 of the flexible container 36. The lower end 42 of the flexible container 36, as shown in FIG. 5, is of a thicker construction than the remaining portions of the flexible container 36. This permits the lower end 42 to withstand the greater pressures to which the lower end 42 may be subjected during the filling operation of container assembly 12. In particular, the major portion of flexible container 36 is preferably of an elongated, generally cylindrical shape, but having a neck portion 39, a closed lower end 42, and a star-like cross-section as shown. The container 36 has an overall length approximately equal to the length of the housing 14. The neck portion 39 has a smaller diameter than the rest of the flexible container 36.

The plastic composition of the flexible container 36 is preferably any suitable, preferably blow moldable material. The plastic composition selected for blow molding the flexible container 36 is preferably substantially inert, i.e., resistant to chemical or physical action of the liquid to be contained within the flexible container 36, such that no substantial traces of the plastic composition—or any of its chemical components—can be detected in the fine mist spray of liquid provided by the apparatus 10. In addition, the plastic composition must further satisfy the requirement that the flexible container 36 will be substantially impermeable with respect to the liquid to be contained, i.e., as determined by the weight loss of the apparatus 10 during storage on a shelf over a long period of time. The weight loss should preferably be two percent or less per year. Preferably the plastic composition can be any of polypropelene, PET, polyester, SARANEX, or a suitable polyamide (such as nylon) or combinations thereof, with the particular choice of composition determined by the choice of liquid to be contained in and dispensed from the apparatus 10.

Upon blow molding the flexible container 36 into the desired shape, the flexible container 36 is provided with a plurality of creases 44 as shown in FIG. 5 which extend longitudinally from the bottom of the neck 39 to the bottom end 42. Each crease 44, as more clearly shown in FIG. 6, is a depression 46 which extends parallel to the longitudinal axis of flexible container 36 as indicated by the line B—B in FIG. 5. As a result, the flexible container 36 in cross section takes on a star-like pattern consisting of alternating depressions 46 and ridges 48. The creases 44 permit the flexible container 36 to be folded inwardly along the creases 44 in the direction of the arrows indicated in FIG. 6. In this fashion, the flexible container 36 can be easily folded inwardly toward its longitudinal axis in a compact and uniform manner so as to aid in regulating the expansion of the flexible container 36 in a substantially radial direction with negligible, if any, longitudinal variations. If desired, the flexible container 36 can be secured to a vacuum pump so as to evacuate the inner region 40. In this fashion the flexible container 36 can be readily folded so as to permit the assembly of the container assembly 12 to proceed in a quick and efficient manner.

One method of forming the creases 44 is to contact the flexible container 36 with a series of suitable arranged spaced apart rods, molds, or the like which are heated and pressed against the surface of the blow molded flexible container 36. Alternately, the flexible container 36 can be blow molded into a mold having the desired configuration which can then be removed after the flexible container 36 assumes the desired shape.

The aperture 37 through the top end 38 of flexible container 36 is surrounded by an outwardly extending flange 52 integrally formed with the flexible container 36 so as to facilitate connection of the flexible container 36 to the valve structure 53 which will be described in greater detail below.

Referring now to FIG. 7, the valve structure 53 includes a valve body 54 having a flange 54 and a hollow tubular portion 56 extending downwardly therefrom. The tubular portion 56 engages at its lower end an annular disk 60 integral with the bottom end of tubular portion 56 and has a centrally positioned opening 61. The upper end of tubular portion 56 is recessed to receive a rubber gasket 62 having a centrally positioned opening 64. Ridges 66 extending upwardly from the recess of the top end of tubular portion 56 provide further sealing between the gasket 62 of rubber (or other suitable material) and the valve body 54. A spring 58 is positioned within the hollow region of tubular portion 56 as shown in FIG. 7. The lower end of spring 58 rests against the disk 60. The upper end of the spring 58 engages a valve disk 68 which is pressed against the rubber gasket 62 by the spring 58 under compression. The upper portion of spring 58 is positioned around a projection member 69 extending downwardly of the valve disk 68 so that the spring 58 is retained in place.

The flange 54 has an outside radial dimension comparable to that of flange 52 of flexible container 36. Also, the tubular portion section 56 has an outside diameter which is less than the inside diameter of the flange 52 so as to facilitate insertion of tubular portion 56 through opening 37 of the top end 38 of flexible container 36 during assembly.

Thereafter, an annular locking ring 70, having an inside diameter greater than the outside diameter of the neck 39 of flexible container 36 and having a flange 72 adapted to mate with the undersurface of flange 52 is passed over the bottom end 42 of the flexible container 36 and is moved along the longitudinal axis B—B until it presses against the undersurface of the flange 52 of flexible container 36. A ferrule 74, having an upper disk portion 76 and downwardly extending wall 78 which engages the outer edges of flange 55, 52 and 72.

The lower edges of the wall 78 are then crimped inwardly so as to seal the inner region 40 from the atmosphere. In aid of this sealing, alternating ridges and depressions are provided in the upper surfaces of flanges 52 and 72 which engage cooperating ridges and depressions in the lower surfaces of flanges 55 and 52 respectively as illustrated in FIG. 7. The disk portion 76 of ferrule 74 has a centrally positioned opening 80 which is adapted to receive the stem 28 of the actuator cap 18. The valve disk 68 has a diameter smaller than that of the hollow region within the tubular portion 56 for a purpose to be explained hereinbelow. The valve disk 68 provides a fluid tight seal between its upper surface and the rubber gasket 62 when pressed thereagainst by the spring 58 under compression.

In operation, the stem 29 presses against the valve disk 68 which is thereby separated from the rubber gasket 62 so as to permit passage of liquid from the inner region 40 of flexible container 36 up through opening 61, through the hollow region within the tubular portion 56, around the valve disk 68 and out through openings 64 and 80.

Figure 9:
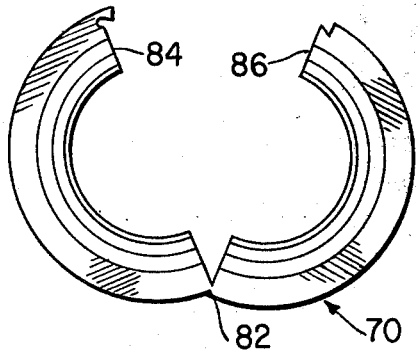
FIG. 9 is a top view of an alternate embodiment of the locking ring of FIG. 7.

As illustrated in FIG. 9, the locking ring 70 alternately can be integrally molded of a split construction having a smaller dimension at the midpoint 82 of the locking ring 70. The opposite ends 84 and 86 are adapted so as to interlock when connected and thereby retain the locking ring in place about the neck 39 of flexible container 35. In this fashion, the locking ring 70 can be applied about the neck 39 of flexible container 36 during the connection of the latter to the valve assembly 16 without having to pass the locking ring 70 over the length of the flexible container 36.

Figure 10:
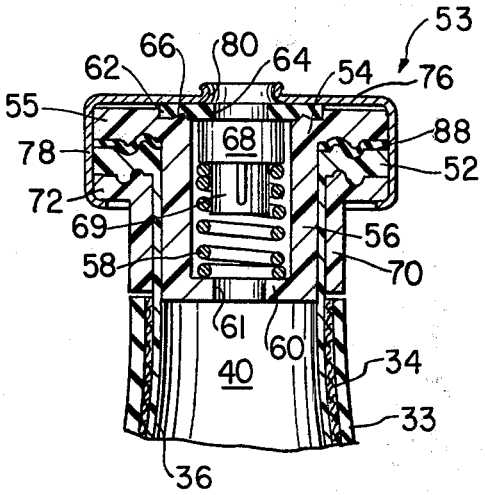
FIG. 10 is an enlarged cross-sectional view of the valve assembly of FIG. 1 connected to the container assembly of FIG. 3 illustrating a gasket for sealing between the container and the valve assembly.

Referring now to FIG. 10, if desired, the valve assembly 16 as shown can further include a gasket 88 of a suitable rubber material and sandwiched between flange 55 of valve body 54 and flange 52 of flexible container 36 to provide additional sealing.

Although the connection of the valve assembly 16 and flexible container 36 as described above in the preferred embodiment is substantially mechanical, other mechanical and nonmechanical sealing means or methods can be alternatively employed. Such other sealing means or methods which are contemplated include gluing, bonding or welding the flexible container 36 directly to the undersurface of flange 55 of valve portion 54. A preferred alternative includes ultrasonically welding the flange 52 to the flange 55, to the outer wall of tubular portion 56 and/or to the surfaces of locking ring 70.

Once folded, the flexible container 36 is surrounded by fabric sleeve 34 as shown in FIG. 4 which is composed of textile fiber yarns in at least the longitudinal direction of the flexible container 36 and elastomeric fibers in the circumferential direction. The fabric sleeve 34 is open at both ends and need not be connected or secured to the valve assembly 16. A preferred construction of the fabric sleeve 34 includes a sleeve which is warp-knitted of textile yarns which include synthetic or natural yarns layed into the warp knitted fabric and extend circumferentially of the sleeve at spaced locations along the length thereof. The structure of the fabric sleeve 34 is such as to permit energy sleeve 33 and thus, flexible container 36 to expand substantially in a radial direction while frictional resistance of the textile yarns prevents or minimizes any longitudinal expansion of the energy sleeve 33 during the operation of filling the container 36 with a desired liquid under pressure. The textile yarns should be suitable to provide the desirable frictional resistance and are preferably polyamide yarns, such as nylon fiber yarns.

An elastomeric energy sleeve 33 is then placed, as shown in FIG. 4, in surrounding relationship with the fabric sleeve 34. The energy sleeve 33 is similar in configuration to the fabric sleeve 34 and has an inner diameter preferably less than the outer diameter of the fabric sleeve 34 when it is positioned about flexible container 36. This provides a tight fitting assembly for fabric sleeve 34 and flexible container 36. The energy sleeve 33 is also open at both ends as is the fabric sleeve 34 and similarly need not be secured to the valve assembly 16 as was necessary in the prior art arrangements. For this reason, the avoidance of additional connecting fasteners eliminates the problems caused by failures of such fasteners in the prior art arrangements. Once expanded, the energy sleeve 33 provides a contracting force to return the container 36 toward its original folded condition as the liquid under pressure is selectively permitted to exit the container 36.

Once assembled as shown in FIG. 4, the container assembly 12 is positioned within container housing 14 and snap-fitted thereto by securement of the valve assembly 16 to the flange 21 of housing 12 as described above with reference to FIG. 1.

Upon connecting the apparatus 10 to a suitable filling device (not shown), the container assembly 12 is filled with the desired liquid medium whereupon the container assembly 12 expands to its filled condition as shown in FIG. 2. Upon slidably fitting the actuator cap 18 onto the retainer ring 17 with stem 29 extending through aperture 30, the apparatus 10 is ready for use. Pressing the actuator cap 18 downwardly in the direction of arrow "A" as illustrated in FIG. 2 opens the valve structure 53 so as to permit liquid within inner region 40 of flexible container 36 to pass freely through opening 30 of actuator cap 18 as a fine mist spray.

Preferably the outer surface of the energy sleeve 32 is slightly inward of the inner surface of container housing 14 so as to avoid distortion of the container housing 14. As a result of the structure of the fabric sleeve 34, the longitudinal nylon yarns provide frictional resistance in the longitudinal direction against the inner surface of energy sleeve 33 and the expansion of the energy sleeve 33 is regulated or programmed so as to expand substantially in a radial direction with negligible, if any, longitudinal variation. However, the overall length of the container assembly 12 in its filled condition may be slightly less than in its unfilled condition as seen upon comparison of FIGS. 1 and 2.

Accordingly, the energy sleeve 33 may fully expand to its desired size within the housing 14 without engaging any portions of the inner wall of housing 14 prior to achieving full expansion. In doing so, the energy sleeve 33 is not subjected to the difficulties encountered in known dispenser systems as described above. Furthermore, the dispensing of liquid from the flexible container 36 is obtained in a constant fashion from the completed apparatus 10 without any erratic departures therefrom.

Figure 11:
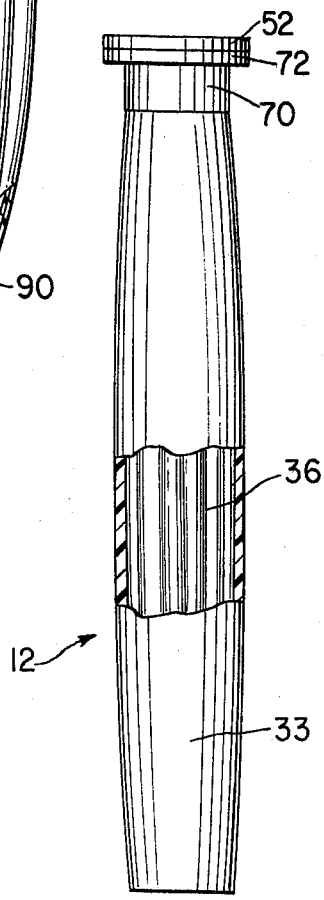
FIG. 11 is a side elevational view, partially in cross-section, illustrating an alternate embodiment of the blow molded flexible inner container of FIG. 5.

Referring now to FIGS. 8–11, alternate embodiments of the container assembly 12 will be described. In FIG. 11, an energy sleeve 33 is shown in surrounding relationship about a flexible container 36 in a folded condition, but without the fabric sleeve 34 shown in the previous embodiments. By employing a flexible container 36 blow molded of a plastic composition preferably having at least some elastic properties, the configuration and construction of the flexible container 36 can itself provide for the regulation of the expansion of the energy sleeve 33 in a substantially radial direction with negligible if any, variations along the longitudinal axis of the flexible container 36.

Figure 8:
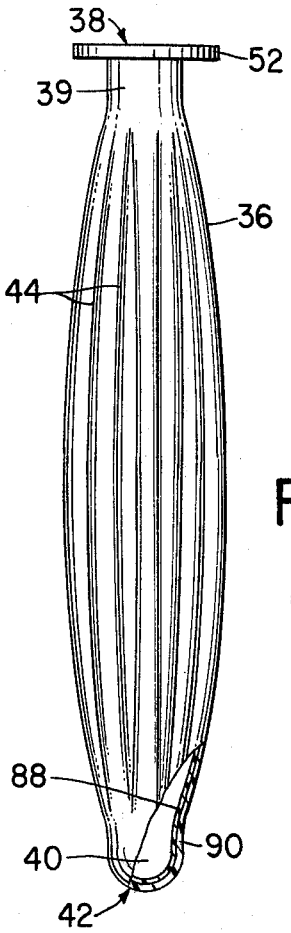
FIG. 8 is a cross-sectional view of an alternate embodiment of the blow molded flexible container illustrating a double wall flexible container construction.

Referring now to FIG. 8, the flexible container 36 alternately can be integrally formed of a plastic composition including at least two different plastics blow molded as a co-extruded double wall construction of at least two separate layers each layer corresponding to one of the different plastics. The inner layer 88 is contiguous to the inner region 40 of the flexible container 36. The inner layer 88 preferably is either polypropylene or polyethylene or any other suitable material as determined by the non-leaching and impermeability requirements as described above with respect to the particular liquid to be contained within the container assembly 12. The outer layer 90 provides strength and is preferably of such materials as polyester, film forming polyamide such as nylon, or the like. Such a double wall construction provides not only greater strength but increased potential for the non-leaching and impermeable capability of the flexible container 36 relative to the liquid contained therein. This is made possible by employing the advantages of different plastic compositions in various combinations, as desired, e.g., some plastics may offer better "inert" or non-leaching capability while others may offer increased impermeability or strength.

I claim:

1. An apparatus for containing and dispensing a fluid medium under pressure comprising:

(a) substantially inert flexible means defining an inner region for containing the fluid medium under pressure and capable of being folded about one axis in its empty condition and expanded at least in directions substantially transverse to said axis when filled with the fluid medium under pressure;

(b) a sleeve disposed outwardly of and surrounding said flexible container means, said sleeve having a generally fabric-like configuration and being generally resilient at least in directions substantially transverse to said axis;

(c) a resilient tubular member positioned outwardly of said sleeve, said resilient tubular member extending at least over the length of said sleeve and being expandable in directions substantially transverse to said axis when said flexible container means is filled with the fluid medium under pressure; and (d) valve means connected to said flexible container means and adapted to substantially prevent evacuation of said flexible container means under normal conditions and capable of selectively providing communication between said inner region of said flexible container means and the outside atmosphere thereby to permit selective amounts of the pressurized fluid medium to exit said flexible container due to the generally inward forces provided by said resilient member in its generally expanded condition.

2. An apparatus for containing and dispensing fluid under pressure comprising:

(a) a flexible container defining an inner region for containing the fluid under pressure and capable of being folded in its empty condition and expanded at least in substantially radial outward directions when filled with the fluid under pressure, said container being constructed of a material which is substantially inert with respect to the fluid to be contained therein;

(b) a sleeve disposed radially outwardly of an surrounding said flexible container in its folded condition, said sleeve having a generally fabric-like configuration and being generally resilient at least in radial directions so as to be capable of being expanded at least in generally radial directions when said flexible container is filled with the fluid under pressure;

(c) a resilient tubular member positioned radially outwardly of said sleeve, said resilient member extending at least over the length of said sleeve and being expandable at least in radial directions when said flexible container is filled with the fluid under pressure; and (d) valve means connected to said flexible container and adapted to substantially prevent evacuation of said flexible container under normal conditions, said valve means being capable of selectively providing communication between said inner region of said flexible container and the outside atmosphere thereby to permit selective amounts of the pressurized fluid to exit said flexible container due to the generally radially inward forces provided by said resilient member in its generally expanded condition.

3. An apparatus for containing and dispensing a liquid under pressure comprising:

(a) a flexible container defining an inner region for containing the liquid under pressure and capable of being folded in its empty condition and expanded at least in substantially radial outward directions when filled with the liquid under pressure, said flexible container being constructed of a material which is substantially non-permeable and substantially inert at least with respect to the liquid to be contained therein;

(b) a generally elongated, tubular sleeve disposed radially outwardly of and surrounding said flexible container, said sleeve being constructed predominantly of textile yarns at least in longitudinal directions and having resilient yarn-like members in circumferential directions at spaced positions along its length such that said sleeve is generally resilient when expanded at least in substantially radial outward directions when said flexible container is filled with the liquid under pressure;

(c) a generally elongated, resilient tubular member positioned radially outwardly of said predominantly textile sleeve, said tubular member extending at least over the length of said predominantly textile sleeve and being expandable at least in radial directions when said flexible container is filled with the liquid under pressure such that frictional interaction between said predominantly textile sleeve and said resilient tubular member at least in longitudinal directions prevents substantial elongation of said resilient tubular member when said flexible container is filled with the liquid under pressure but permits expansion of said resilient tubular member in radially outward directions substantially uniformly along its length; and (d) valve means connected to said flexible container and adapted to substantially prevent evacuation of said flexible container under normal conditions and capable of selectively providing communication between said inner region of said flexible container and the outside atmosphere thereby to permit selective amounts of said pressurized liquid to exit said flexible container due to the generally radially inward forces provided by said resilient tubular member in its generally expanded condition.

4. The apparatus according to claim 3 wherein said predominantly textile sleeve is a tubular member comprised of textile fiber yarns at least in the longitudinal direction of said flexible container.

5. The apparatus according to claim 4 wherein said textile fiber yarns are constructed of nylon or cotton so as to provide frictional interaction between said textile sleeve and said resilient tubular member such that expansion of said resilient tubular member is regulated to have substantially negligible variations along the longitudinal direction when said flexible container is filled with the liquid under pressure.

6. The apparatus according to claim 5 wherein said resilient yarn-like members are comprised of synthetic or natural rubber such that expansion of said resilient tubular member is regulated in substantially radial directions along its length when said flexible container is filled with the liquid under pressure.

7. The apparatus according to claim 6 wherein said predominantly textile sleeve has a length approximately equal to the length of said flexible container.

8. The apparatus according to claim 7 wherein said predominantly textile sleeve is open at both ends.

9. The apparatus according to claim 8 wherein said resilient tubular member is constructed of rubber.

10. The apparatus according to claim 9 wherein said resilient tubular member has a length approximately equal to the length of said flexible container.

11. The apparatus according to claim 10 wherein said resilient tubular member is open at both ends.

12. The apparatus according to claim 11 wherein said resilient tubular member has an inner diameter less than the outer diameter of said fabric sleeve so as to provide when positioned about said flexible container a tight fitting assembly for said textile sleeve about said flexible container.

13. An apparatus for containing and dispensing a liquid under pressure comprising:

(a) a non-elastomeric, substantially non-permeable flexible container defining an inner region for containing the liquid under pressure and capable of being folded in its empty condition and expanded at least in substantially radial outward directions when filled with the liquid under pressure, said flexible container being constructed of a material which is substantially chemically and physically inert with respect to the liquid to be contained therein;

(b) a generally elongated, tubular sleeve disposed radially outwardly of and surrounding said flexible container, said sleeve being constructed predominantly of textile yarns at least in longitudinal directions and having resilient yarn-like members in circumferential directions at spaced positions along its length such that said sleeve is generally resilient when expanded at least in substantially radial outward directions when said flexible container is filled with the liquid under pressure;

(c) a generally elongated, resilient tubular member positioned radially outwardly of said predominantly textile sleeve, said tubular member extending at least over the length of said predominantly textile sleeve and being expandable at least in radial directions when said flexible container is filled with the liquid under pressure such that frictional interaction between said predominantly textile sleeve and said resilient tubular member at least in longitudinal directions prevents substantial elongation of said resilient tubular member when said flexible container is filled with the liquid under pressure but permits expansion of said resilient tubular member in radially outward directions substantially uniformly along its length; and (d) valve means connected to said flexible container and adapted to substantially prevent evacuation of said flexible container under normal conditions and capable of selectively providing communication between said inner region of said flexible container and the outside atmosphere thereby to permit selective amounts of said pressurized liquid to exit said flexible container due to the generally radially inward forces provided by said resilient tubular member in its generally expanded condition.

14. The apparatus according to claim 13 wherein said flexible container is formed of a plastic material.

15. The apparatus according to claim 14 wherein said flexible container is integrally molded of a plastic material.

16. The apparatus according to claim 15 wherein said plastic material is integrally blow molded of a plastic composition.

17. The apparatus according to claim 16 wherein said plastic composition is nylon, polypropylene, polyester or SARANEX.

18. The apparatus according to claim 17 wherein said blow molded container has a plurality of longitudinally extending creases so as to permit said blow molded container to be folded inwardly along said creases.

19. The apparatus according to claim 18 wherein said blow molded container is of a generally cylindrical configuration and has an aperture at one end thereof to which the plurality of creases extend, said aperture permitting connection of said blow molded container with said valve means and communication of said inner region with the outside atmosphere.

20. The apparatus according to claim 19 wherein said blow molded container has an outwardly extending integral flange adjacent said one end so as to facilitate connection of said blow molded container to said valve means.

21. The apparatus according to claim 20 wherein said blow molded container is of a thicker construction at the other end thereof so as to render said blow molded container capable of withstanding the pressure caused by the liquid under pressure.

22. The apparatus according to claim 15 wherein said plastic material is integrally blow molded as a co-extruded double wall construction.

23. The apparatus according to claim 22 wherein said double wall construction is composed of at least two layers, an inner layer and an outer layer, said inner layer being contiguous to said inner region within said flexible container.

24. The apparatus according to claim 23 wherein said inner layer is polypropylene or polyethylene.

25. The apparatus according to claim 24 wherein said outer layer is polyester or nylon.

26. The apparatus according to claim 25 wherein said co-extruded container has a plurality of longitudinally extending creases so as to permit said co-extruded container to be folded inwardly along said creases.

27. The apparatus according to claim 26 wherein said co-extruded container is of a generally cylindrical configuration and has an aperture at one end thereof to which the plurality of creases extend, said aperture permitting connection of said co-extruded container with said value means and communication of said inner region with the outside atmosphere.

28. The apparatus according to claim 27 wherein said co-extruded flexible container has an outwardly extending integral flange adjacent said one end so as to facilitate connection of said co-extruded container to said valve means.

29. The apparatus according to claim 28 wherein said co-extruded container is of a thicker construction at the other end thereof so as to render said co-extruded container capable of withstanding the pressure caused by the liquid under pressure.

30. The apparatus according to any of claims 21 or 29 wherein said valve means includes a valve body having a generally hollow tubular portion adapted so as to be capable of being inserted within the aperture at one end of said container, an annular locking ring adapted so as to be capable of being passed over the other end and over the length of said container, a ferrule configured and dimensioned so as to be capable of securing together said valve body, said container, and said locking ring in a fluid tight arrangement, the valve means including suitable apertures so as to permit communication between said inner region of said container and the outside atmosphere upon activation of the valve means.

31. The apparatus according to claim 30 wherein said valve body includes a flange comparable in radial dimension to that of said flange of said container and adapted so as to be capable of seating atop said flange of said container.

32. The apparatus according to claim 31 wherein said annular locking ring includes a flange comparable in radial dimension to that of said flange of said container and adapted so as to be capable of seating beneath said flange of said container.

33. The apparatus according to claim 32 wherein the ferrule is crimped in position about outer edges of the flanges of the valve body, said container and the annular locking ring so as to tightly secure the flanges.

34. The apparatus according to claim 33 wherein a rubber gasket is positioned centrally between the ferrule and the valve body.

35. The apparatus according to claim 34 further including a valve disk positioned within the hollow region of the tubular portion, a spring also positioned within the hollow region so as to bias the valve disk against the rubber gasket so as to provide a fluid tight seal therebetween.

36. The apparatus according to claim 35 wherein the valve disk is of a smaller radial dimension than the hollow region so as to permit liquid from said inner region of said container to pass through the hollow region and around the sides of the valve disk into the atmosphere when said valve means is activated.

37. The apparatus according to claim 36 further including a rubber gasket positioned between the flange of the valve body and said flange of said container so as to further aid in providing a fluid tight seal therebetween.

38. An apparatus for containing and dispensing a liquid under pressure comprising:

(a) a container housing having an opening at one end thereof;

(b) a non-elastomeric flexible container integrally formed of a blow molded generally homogeneous plastic composition and having a plurality of longitudinally extending creases, said blow molded container defining an inner region for containing the liquid under pressure and capable of being folded inwardly along said creases about a longitudinal axis thereof in its empty condition and expanded at least in substantially radially outward directions when filled with the liquid under pressure, said blow molded container being substantially chemically and physically inert and substantially non-permeable with respect to the liquid contained therein;

(c) a generally elongated, tubular textile sleeve disposed radially outwardly of and surrounding said blow molded container, said textile sleeve being generally resilient at least in radial directions and having resilient yarn-like members in circumferential directions along its length such that said textile sleeve is capable of being expanded in substantially radial directions when said blow molded container is filled with the liquid under pressure, said textile sleeve being knitted of nylon fiber yarns;

(d) a resilient generally tubular member positioned radially outwardly of said textile sleeve, said resilient tubular member extending at least over the length of said textile sleeve and being expandable in radial directions when said blow molded container is filled with the liquid under pressure, said resilient tubular member frictionally interacting with said nylon yarns of said textile sleeve when said blow molded container is filled with the liquid under pressure such that said resilient tubular member expands generally uniformly in substantially radial directions along its length; and (e) valve means connected to said blow molded container, said valve means further being secured to one end of said container housing at the opening thereof when said blow molded container, textile sleeve and resilient tubular member are assembled and positioned therein, said valve means being adapted to substantially prevent evacuation of said blow molded container under normal conditions and capable of selectively providing communication between said inner region of said blow molded container and the outside atmosphere thereby to permit selective amounts of said pressurized liquid to become dispersed and to exit said blow molded container due to the generally radially inward forces provided by said resilient tubular member in its generally expanded condition.

39. An apparatus for containing and dispensing a liquid under pressure comprising:

(a) a container housing having an opening at one end thereof;

(b) a flexible cylindrical container integrally formed of a blow molded generally homogeneous elastic plastic composition and having a central longitudinal axis, said blow molded container having a neck portion and a plurality of longitudinally extending creases disposed below said neck portion generally equidistantly from said central longitudinal axis, said blow molded container defining an inner region for containing the liquid under pressure and being folded inwardly along said creases only about said central longitudinal axis in its empty condition and expanded only in substantially radially outward directions when filled with the liquid under pressure, said blow molded container being substantially chemically and physically inert with respect to the liquid contained therein, said configuration and structure of said blow molded container being such that said blow molded container is expanded only in substantially radial directions when said blow molded container is filled with the liquid under pressure;

(c) a resilient generally tubular member positioned radially outwardly of said blow molded container, said resilient tubular member extending at least over the length of said blow molded container and being expandable in radial directions when said blow molded container is filled with the liquid under pressure, said resilient tubular member frictionally interacting with said blow molded container when said blow molded container is filled with the liquid under pressure such that said resilient tubular member and said flexible cylindrical container each expands generally uniformly only in directions substantially radially outwardly of said longitudinal axis along its length; and (d) valve means connected solely to said neck portion and extending into said inner region no further than said neck portion of said blow molded container, said valve means further being secured to one end of said container housing at the opening thereof when said blow molded container and resilient tubular member are assembled and positioned therein, said valve means being adapted to substantially prevent evacuation of said blow molded container under normal conditions and capable of selectively providing communication between said inner region of said blow molded container and the outside atmosphere thereby to permit selective amounts of said pressurized liquid to become dispersed and to exit said blow molded container due to the generally radially inward forces provided by said resilient tubular member in its generally expanded condition.

40. An apparatus for containing and dispensing a liquid under pressure comprising:

(a) a container housing having an opening at one end thereof;

(b) a non-elastomeric flexible container integrally formed of a plastic composition including at least two different plastics blow molded as a co-extruded double wall construction composed of at least two separate layers and having a plurality of longitudinally extending creases, said co-extruded container defining an inner region for containing the liquid under pressure and capable of being folded inwardly along said creases about a longitudinal axis thereof in its empty condition and expanded at least in substantially radially outward directions when filled with the liquid under pressure, said co-extruded container being substantially chemically and physically inert with respect to the liquid contained therein;

(c) a generally elongated, tubular textile sleeve disposed radially outwardly of and surrounding said extruded container, said textile sleeve being generally resilient at least in radial directions and having resilient yarn-like members in circumferential directions along its length such that said textile sleeve is capable of being expanded in substantially radial directions when said co-extruded container is filled with the liquid under pressure, said textile sleeve being knitted of nylon fiber yarns;

(d) a resilient generally tubular member positioned radially outwardly of said textile sleeve, said resilient tubular member extending at least over the length of said textile sleeve and being expandable in radial directions when said co-extruded container is filled with the liquid under pressure, said resilient tubular member frictionally interacting with said nylon yarns of said textile sleeve when said co-extruded container is filled with the liquid under pressure such that said resilient tubular member expands generally uniformly in substantially radial directions along its length; and (e) valve means connected to said co-extruded container, said valve means further being secured to one end of said container housing at the opening thereof when said co-extruded container, textile sleeve and resilient tubular member are assembled and positioned therein, said valve means being adapted to substantially prevent evacuation of said co-extruded container under normal conditions and capable of selectively providing communication between said inner region of said extruded container and the outside atmosphere thereby to permit selective amounts of said pressurized liquid to become dispersed and to exit said extruded container due to the generally radially inward forces provided by said resilient tubular member in its generally expanded condition.

41. An apparatus for containing and dispensing a liquid under pressure comprising:

(a) a container housing having an opening at one end thereof;

(b) a flexible cylindrical container integrally formed of an elastic plastic composition including at least two different plastics blow molded as a co-extruded double wall construction composed of at least two separate layers and having a central longitudinal axis, said co-extruded container having a neck portion and a plurality of longitudinally extending creases disposed below said neck portion generally equidistantly from said central longitudinal axis, said co-extruded container defining an inner region for containing the liquid under pressure and being folded inwardly along said creases only about said central longitudinal axis in its empty condition and expanded only in substantially radially outward directions when filled with the liquid under pressure, said co-extruded container being substantially chemically and physically inert with respect to the liquid contained therein, said configuration and structure of said co-extruded container being such that said co-extruded container is expanded only in substantially radial directions when said co-extruded container is filled with the liquid under pressure;

(c) a resilient generally tubular member positioned radially outwardly of said co-extruded container, said resilient tubular member extending at least over the length of said co-extruded container and being expandable in radial directions when said co-extruded container is filled with the liquid under pressure, said resilient tubular member frictionally interacting with said co-extruded container when said co-extruded container is filled with the liquid under pressure such that said resilient tubular member and said flexible cylindrical container each expands generally uniformly only in directions substantially radially outwardly of said central longitudinal axis along its length; and (d) valve means connected solely to said neck portion and extending into said inner region no further than said neck portion of said co-extruded container, said valve means further being secured to one end of said container housing at the opening thereof when said co-extruded container and resilient tubular member are assembled and positioned therein, said valve means being adapted to substantially prevent evacuation of said co-extruded container under normal conditions and capable of selectively providing communication between said inner region of said co-extruded container and the outside atmosphere thereby to permit selective amounts of said pressurized liquid to become dispersed and to exit said co-extruded container due to the generally radially inward forces provided by said resilient tubular member in its generally expanded condition.

42. A method for manufacturing an apparatus for containing and dispensing a liquid under pressure comprising:

(a) molding a moldable material into an elongated flexible container defining an inner region for containing the liquid and having at least one aperture;

(b) creating a plurality of creases extending along the longitudinal axis of said flexible container so as to permit said molded container to be folded inwardly along said creases;

(c) positioning valve means within said aperture and attaching said flexible container to said valve means so as to form a substantially sealed molded container defining an inner region for containing liquid;

(d) folding said flexible container inwardly along said creases along a longitudinal axis extending through said valve means;

(e) positioning an elongated tubular sleeve radially outwardly of, and surrounding said folded flexible container, said sleeve having a generally fabric-like configuration and having generally resilient properties at least in radial directions; and (f) positioning a resilient tubular member outwardly of and surrounding said sleeve, said resilient member extending at least over the length of said sleeve and capable of being expanded at least in radial directions as said flexible container means is filled with the liquid medium under pressure so as to provide sufficient potential energy within said resilient member such that selectively actuating said valve means provides communication between the inner region of said flexible container and the outside atmosphere while said resilient tubular member causes expulsion of said liquid from the inner region of said flexible container through the valve means to the outside atmosphere.

43. A method for manufacturing an apparatus for containing and dispensing a liquid under pressure comprising:

(a) blow molding a non-elastomeric flexible container integrally formed of a generally homogenous plastic composition said blow molded container defining an inner region for containing the liquid and having at least one aperture;

(b) creating a plurality of creases extending along the longitudinal axis of said blow molded container so as to permit said blow molded container to be folded inwardly along said creases;

(c) positioning valve means within said aperture and attaching said blow molded container to said valve means so as to form a substantially sealed blow molded container defining an inner region for containing liquid; (d) folding said flexible container inwardly along said creases along a longitudinal axis extending through said valve means;

(e) positioning an elongated tubular sleeve radially outwardly of, and surrounding said folded flexible container, said sleeve having a generally fabric-like configuration and having generally resilient properties at least in radial directions; and (f) positioning a resilient tubular member outwardly of and surrounding said sleeve, said resilient member extending at least over the length of said sleeve and capable of being expanded at least in radial directions as said flexible molded container means is filled with the liquid medium under pressure so as to provide sufficient potential energy within said resilient member such that selectively actuating said valve means provides communication between the inner region of said blow molded container and the outside atmosphere while said expanded resilient tubular member causes expulsion of said liquid from the inner region of said blow molded container through the valve means to the outside atmosphere.

44. A method for manufacturing an apparatus for containing and dispensing a liquid under pressure comprising:

(a) blow molding an elongated flexible cylindrical container integrally formed of a generally homogeneous elastic plastic composition and having a central longitudinal axis, said blow molded container having a neck portion, said blow molded container defining an inner region for containing the liquid and having at least one aperture, said blow molded container being substantially chemically and physically inert with respect to the liquid contained therein, said configuration and structure of said blow molded container being such that said blow molded container is expanded only in substantially radial directions when said blow molded container is filled with the liquid under pressure;

(b) creating a plurality of creases extending along the longitudinal axis of said flexible container and disposed below said neck portion generally equidistantly from said central longitudinal axis so as to permit said blow molded container to be folded inwardly only along said creases;

(c) positioning valve means within said aperture and attaching said blow molded container to said valve means so as to form a substantially sealed blow molded container defining an inner region for containing liquid, said valve means connected solely to said neck portion and extending into said inner region no further than said neck portion of said blow molded container;

(d) folding said flexible container inwardly along said creases only along said central longitudinal axis extending through said valve means; and (e) positioning a resilient tubular member outwardly of and surrounding said blow molded container, said resilient member extending at least over the length of said blow molded container and being expanded in radial directions as said blow molded container is filled with the liquid medium under pressure so as to provide sufficient potential energy within said resilient member such that selectively actuating said valve means provides communication between the inner region of said blow molded container and the outside atmosphere while said expanded resilient tubular member causes expulsion of said liquid from the inner region of said blow molded container through the valve means to the outside atmosphere, said resilient tubular member frictionally interacting with said blow molded container when said blow molded container is filled with the liquid under pressure such that said resilient tubular member and said flexible cylindrical container each expands generally uniformly only in directions substantially radially outwardly of said longitudinal axis along its length.

45. A method for manufacturing an apparatus for containing and dispensing a liquid under pressure comprising:

(a) blow molding a non-elastomeric flexible container integrally formed of a plastic composition including at least two different plastics blow molded as a double wall construction composed of at least two separate layers, said co-extruded container defining an inner region for containing the liquid and having at least one aperture;

(b) creating a plurality of creases extending along the longitudinal axis of said co-extruded container so as to permit said co-extruded container to be folded inwardly along said creases;

(c) positioning valve means within said aperture and attaching said co-extruded container to said valve means so as to form a substantially sealed co-extruded container defining an inner region for containing liquid;

(d) folding said co-extruded container inwardly along said creases along a longitudinal axis extending through said valve means;

(e) positioning an elongated tubular sleeve radially outwardly of, and surrounding said folded co-extruded container, said sleeve having a generally fabric-like configuration and having generally resilient properties at least in radial directions; and (f) positioning a resilient tubular member outwardly of and surrounding said sleeve, said resilient member extending at least over the length of said sleeve and capable of being expanded at least in radial directions as said co-extruded container means is filled with the liquid medium under pressure so as to provide sufficient potential energy within said resilient member such that selectively actuating said valve means provides communication between the inner region of said co-extruded container and the outside atmosphere while said expanded resilient tubular member causes expulsion of said liquid from the inner region of said co-extruded container through the valve means to the outside atmosphere.

46. A method for manufacturing an apparatus for containing and dispensing a liquid under pressure comprising:

(a) blow-molding a flexible container integrally formed of an elastic plastic composition including at least two different plastics blow molded as a double wall construction composed of at least two separate layers and having a central longitudinal axis and a neck portion, said co-extruded container defining an inner region for containing the liquid and having at least one aperture, said co-extruded container being substantially chemically and physically inert with respect to the liquid contained therein, said configuration and structure of said co-extruded container being such that said co-extruded container is expanded only in substantially radial directions when said co-extruded container is filled with the liquid under pressure;

(b) creating a plurality of creases extending along the longitudinal axis of said co-extruded container and disposed below said neck portion generally equidistantly from said central longitudinal axis so as to permit said co-extruded container to be folded inwardly only along said creases;

(c) positioning valve means within said aperture and attaching said co-extruded container to said valve means so as to form a substantially sealed co-extruded container defining an inner region for containing liquids, said valve means connected solely to said neck portion and extending into said inner region no further than said neck portion of said co-extruded container;

(d) folding said co-extruded container inwardly along said creases only along said central longitudinal axis extending through said valve means; and (e) positioning a resilient tubular member outwardly of and surrounding said co-extruded container, said resilient member extending at least over the length of said co-extruded container and being expanded in radial directions as said co-extruded container is filled with the liquid medium under pressure so as to provide sufficient potential energy within said resilient member such that selectively actuating said valve means provides communication between the inner region of said co-extruded container and the outside atmosphere while said expanded resilient tubular member causes expulsion of said liquid from the inner region of said co-extruded container through the valve means to the outside atmosphere, said resilient tubular member frictionally interacting with said co-extruded container when said co-extruded container is filled with the liquid under pressure such that said resilient tubular member and said co-extruded container each expands generally uniformly only in directions substantially radially outwardly of said central longitudinal axis along its length.

47. The method according any of claims 42–46 wherein the major portion of said flexible container is generally cylindrical.

48. The method according to claim 47 further comprising positioning said apparatus for containing and dispensing a liquid under pressure into an outer container housing.

49. The method according to claim 48 further comprising pumping liquid under pressure into said flexible container through said valve means so as to at least cause generally radial expansion of said flexible container, and said resilient tubular member at least sufficient to provide a predetermined liquid quantity and pressure within said inner region of said flexible container.

50. The method according to any of claims 42, 43 and 45 wherein said tubular sleeve is a predominantly textile sleeve of warp knit nylon construction having resilient yarn-like members positioned therein and extending generally circumferentially at spaced locations along the length of said sleeve.

* * * * *